US007895713B2

(12) United States Patent
Williams, Jr.

(10) Patent No.: US 7,895,713 B2
(45) Date of Patent: Mar. 1, 2011

(54) FENCE HINGE

(75) Inventor: Peter E. Williams, Jr., St. James, NY (US)

(73) Assignee: Eastern Wholesale Fence Co., Inc., Medford, NY (US)

( * ) Notice: Subject to any disclaimer, the term of this patent is extended or adjusted under 35 U.S.C. 154(b) by 558 days.

(21) Appl. No.: 11/949,361

(22) Filed: Dec. 3, 2007

(65) Prior Publication Data

US 2009/0140228 A1 Jun. 4, 2009

(51) Int. Cl.
*E05D 7/04* (2006.01)

(52) U.S. Cl. ..... 16/387; 16/238; 16/252; 16/389

(58) Field of Classification Search ..... 16/387, 16/389, 392, 307, 86.1, 86.2, 236–238, 285, 16/252; 49/381, 382; 256/20, 21, 24, 25, 256/26, 30, 54
See application file for complete search history.

(56) References Cited

U.S. PATENT DOCUMENTS

| | | | | | |
|---|---|---|---|---|---|
| 1,432,782 | A * | 10/1922 | Phillips | | 16/387 |
| 1,526,546 | A * | 2/1925 | Holm | | 16/392 |
| 3,591,247 | A * | 7/1971 | Berry et al. | | 312/304 |
| 3,604,154 | A * | 9/1971 | Curran | | 49/501 |
| 4,141,110 | A * | 2/1979 | Wanek | | 16/252 |
| 4,421,366 | A * | 12/1983 | Niziol | | 312/265.6 |
| 4,722,514 | A | 2/1988 | Pettit | | |
| 5,938,184 | A | 8/1999 | DeSouza | | |
| 6,131,888 | A | 10/2000 | Brown | | |
| 6,176,043 | B1 | 1/2001 | Gibbs | | |
| 6,398,193 | B1 | 6/2002 | DeSouza | | |
| 6,418,590 | B1 * | 7/2002 | Nipper et al. | | 16/382 |
| 6,721,995 | B2 * | 4/2004 | Cress et al. | | 16/382 |
| 6,896,244 | B2 | 5/2005 | Boroviak | | |
| 7,032,892 | B2 | 4/2006 | Boroviak | | |
| 7,665,187 | B1 * | 2/2010 | Elowsky | | 16/390 |
| 2002/0066897 | A1 | 6/2002 | Meis et al. | | |
| 2003/0217515 | A1 | 11/2003 | Boroviak | | |
| 2004/0111974 | A1 | 6/2004 | Boroviak | | |
| 2004/0206948 | A1 | 10/2004 | Lappen | | |
| 2005/0120517 | A1 * | 6/2005 | Bonham | | 16/238 |
| 2005/0183238 | A1 * | 8/2005 | McCue et al. | | 16/236 |

* cited by examiner

*Primary Examiner*—Chuck Y. Mah
(74) *Attorney, Agent, or Firm*—Scully, Scott, Murphy & Presser, P.C.

(57) ABSTRACT

A hinge apparatus includes a first support member for attachment along a first surface of a vertical member such as a fence post. The first support member includes at least one flange angularly extending from the first support member for attachment along a second surface adjacent to the first surface of the vertical member. A hinge coupled to the first support member, and a second support member includes an extended element coupled to the hinge. The second support member attaches to a first surface of a swinging member, such as a fence gate, opposite the first support member. The second support member includes at least one flange angularly extending from the second support member for attachment along a second surface of the swinging member adjacent to the first surface of the swinging member.

14 Claims, 3 Drawing Sheets

20
18
22
32
16
44
30
48
46
47
68
60
34
64
10a
14a
24a
42
24a
16
50a
24a
52a
19
68
14b
24a
24a
50b
10b
16
16
44
47
42
52b
24a
34
32
48
47
69

FENCE HINGE

FIELD OF THE INVENTION

The present invention relates to hinges, and more specifically, relates to a hinge assembly for a gate or door.

BACKGROUND OF THE INVENTION

Polyvinyl chloride (PVC) is commonly used in the manufacture of fencing and fence components. For example, fence gates may be built by first cutting each end of two standard length PVC gate posts and two standard length PVC gate rails. The ends of the fence posts and rails are then welded together to form a rectangular gate structure. One problem that arises with the use of PVC fence gates is caused by welded connections being weak, and thus the welded connections can open and/or crack under normal usage. Additionally, another problem with PVC gates, for example, arises when the user or installer attempts to attach metallic parts directly to the PVC material. In many instances, there is a tendency for the screws to tear out of the PVC material.

In an attempt to strengthen PVC fences, support members are used and include bolting rail and post gate members to the PVC fence. However, if these support members are bolted too tightly, the gate rail and post members tend to cave in. In addition, the use of nuts and bolts results in a connection that is aesthetically unappealing.

Therefore, a need exists for a hinge apparatus which will remain sturdily attached to a PVC fence gate and post. Further, it would be desirable for the hinge apparatus to be aesthetically pleasing and easy to assemble.

SUMMARY OF THE INVENTION

In an aspect of the invention, a hinge apparatus includes a first support member for attachment along a first surface of a vertical member. The first support member includes at least one flange angularly extending from the first support member for attachment along a second surface adjacent to the first surface of the vertical member. A hinge is coupled to the first support member; and a second support member including an extended element is coupled to the hinge and coupled to the second support member. The second support member is attached to a first surface of a swinging member opposite the first support member. The second support member includes at least one flange angularly extending from the second support member for attachment along a second surface of the swinging member adjacent to the first surface of the swinging member. Alternatively, the flange may extend substantially perpendicular from the first support member. In one embodiment of the invention, the swinging member is a fence gate and the vertical member is a fence post. In another embodiment of the invention, the first and second support members each include a plurality of flanges in spaced relation to each other.

In a related aspect, the apparatus further includes another second support member flange angularly extending from the second support member for attachment to a third surface of the swinging member adjacent to the first surface of the swinging member.

In a related aspect, a plurality of first support member flanges angular extending from the first support member for attachment to the second surface of the vertical element. The second support member flange angularly extending from the second support member for attachment to the second surface of the swinging member, and another second support member flange angularly extends from the second support member for attachment to a third surface of the swinging member adjacent to the first surface of the swinging member.

In a related aspect, the first and second support members are attached to the first surface of the vertical member and the first surface of the swinging member, respectively, using screws. Alternatively, the screws may only penetrate the first surfaces.

In a related aspect, the vertical member is a door frame and the swinging member is a door. In one embodiment of the invention, the second support member includes an extended support arm for attachment to the first surface of the swinging member.

In a related aspect, the second support member is substantially vertical and coupled to a substantially horizontal extended support arm in an L-shape for mating with the first surface of the swinging member. Alternatively, the vertical member and the swinging member are polyvinyl chloride (PVC). In an alternative embodiment, the hinge includes a resilient member for resiliently returning the swinging member to a beginning position. In another alternative embodiment, the second surface of the swinging member is opposite the second surface of the vertical member.

In a related aspect, the apparatus further includes a plurality of first support members attached in spaced relation to the first surface of the vertical member. Each of the first support members includes at least one flange angularly extending from the first support members for attachment along the second surface adjacent to the first surface of the vertical member. A plurality of hinges are coupled to the plurality of first support members. A plurality of second support members are each including extended elements coupled to respective hinges and first support members. Each of the second support members are for attachment to the first surface of the swinging member opposite respective first support members. The second support members each include at least one flange angularly extending from the second support members for attachment along the second surface of the swinging member adjacent to the first surface of the swinging member.

In another aspect of the invention a hinge system includes a top first support member for attachment to an upper region of a first surface of a vertical member. A bottom first support member for attachment to a lower region of the first surface of the vertical member. The top and bottom first support members each include at least one flange angularly extending from the top and bottom first support members for attachment along a second surface adjacent to the first surface of the vertical member. Hinges are coupled to the top and bottom first support members. Top and bottom second support members each include extended elements coupled to respective hinges. The top and bottom second support members attach to a first surface of a swinging member opposite respective top and bottom first support members. The top and bottom second support members each include at least one flange angularly extending from the top and bottom second support members for attachment along a second surface of the swinging member adjacent to the first surface of the swinging member.

In a related aspect, the system further includes another second support member flange angularly extending from the second support member for attachment to a third surface of the swinging member adjacent to the first surface of the swinging member.

In another aspect of the invention, a method of attaching a hinge apparatus includes attaching a first support member along a first surface of a vertical member; attaching to a second surface of the vertical member adjacent to the first surface of the vertical member at least one flange angularly extending from the first support member; coupling a hinge to the first support member; coupling a second support member including an extended element to the hinge; attaching the second support member to a first surface of a swinging member opposite the first support member; and attaching another flange angularly extending from the second support member along a second surface of the swinging member adjacent to the first surface of the swinging member.

In a related aspect, the method further comprises attaching another flange angularly extending from the second support member to a top surface of the swinging member adjacent to the first surface of the swinging member.

In a related aspect, the method further includes covering welds in a PVC vertical member and a PVC swinging gate by attaching the flanges over the welds.

BRIEF DESCRIPTION OF THE DRAWINGS

These and other objects, features and advantages of the present invention will become apparent from the following detailed description of illustrative embodiments thereof, which is to be read in connection with the accompanying drawings, in which.

DETAILED DESCRIPTION OF THE INVENTION

Figure 1:
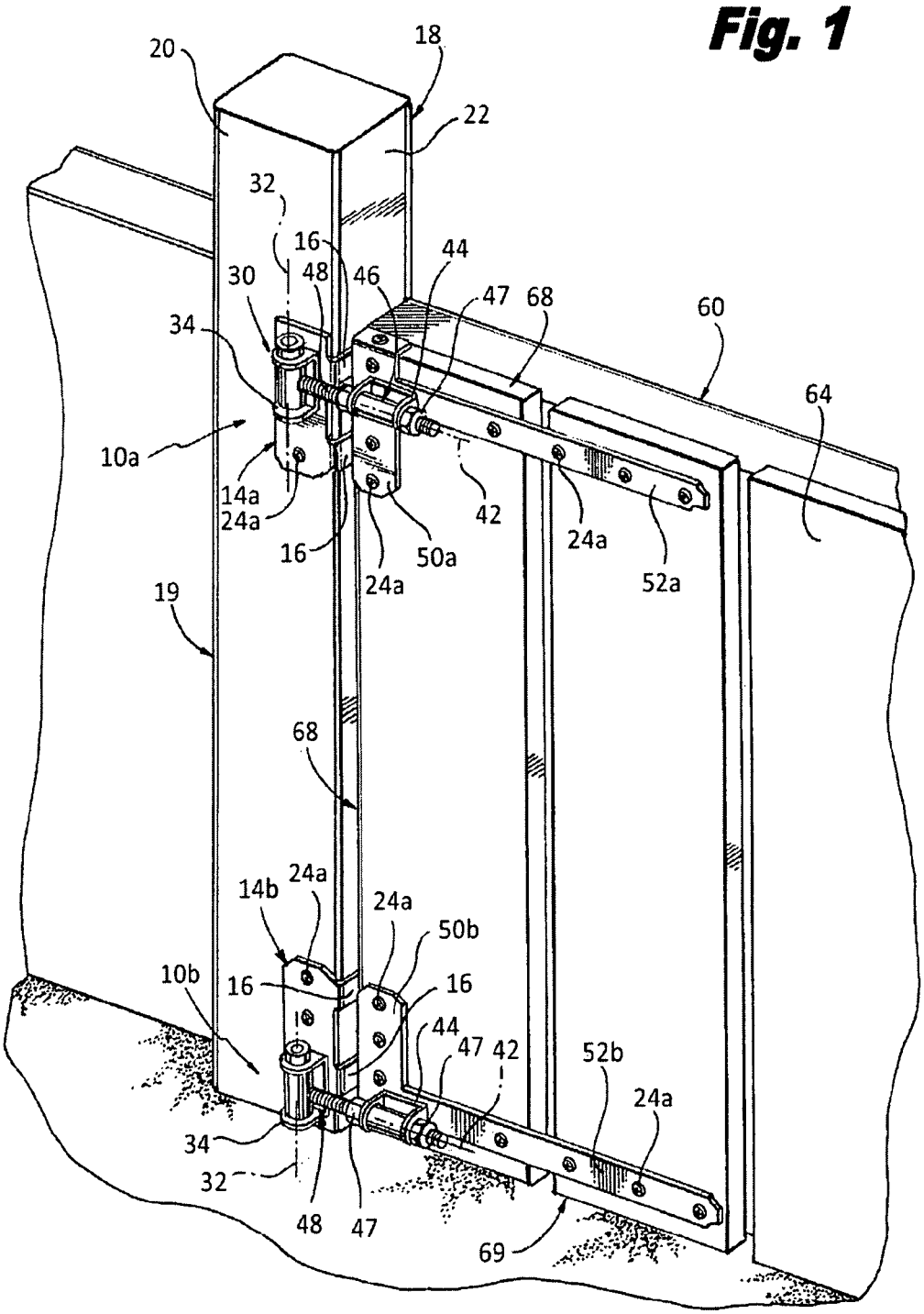
FIG. 1 is a perspective view of a hinge assembly according to an embodiment of the invention depicting upper and lower hinge assemblies each having multiple flanges and attached to a fence gate and fence post.
Figure 2:
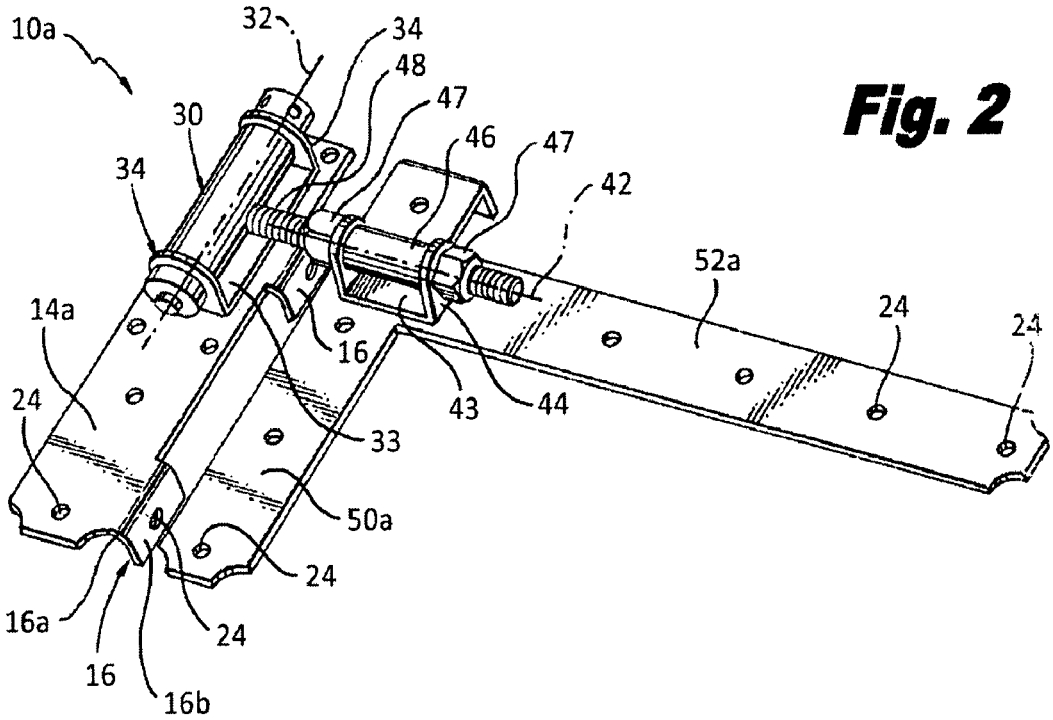
FIG. 2 is a perspective view of the upper hinge assembly shown in FIG. 1.
Figure 3:
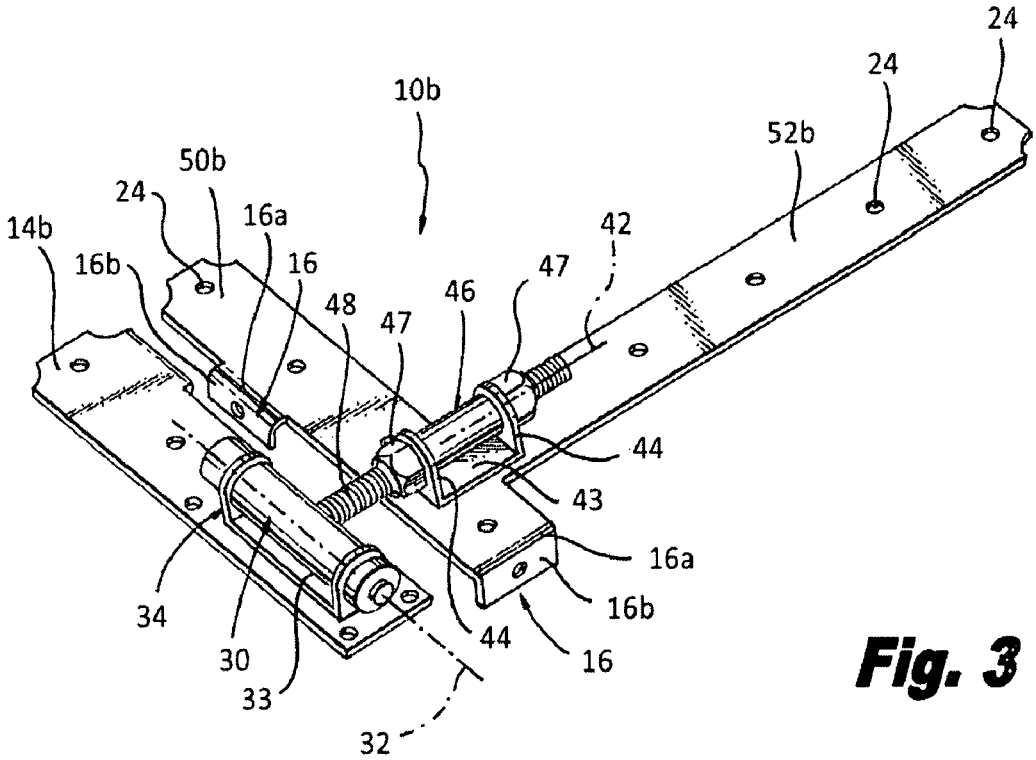
FIG. 3 is a perspective view of the lower hinge assembly shown in FIG. 1.
Figure 4:
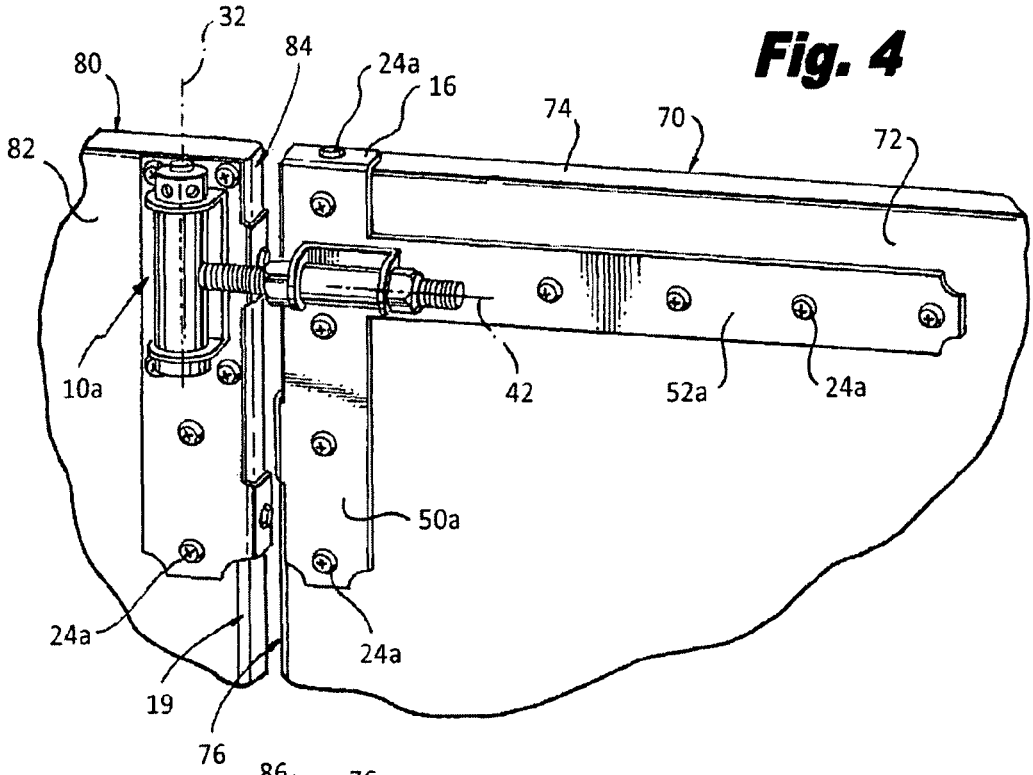
FIG. 4 is a partial perspective view of the upper hinge shown in FIG. 2 attached to a fence gate or swinging door and a wall.
Figure 5:
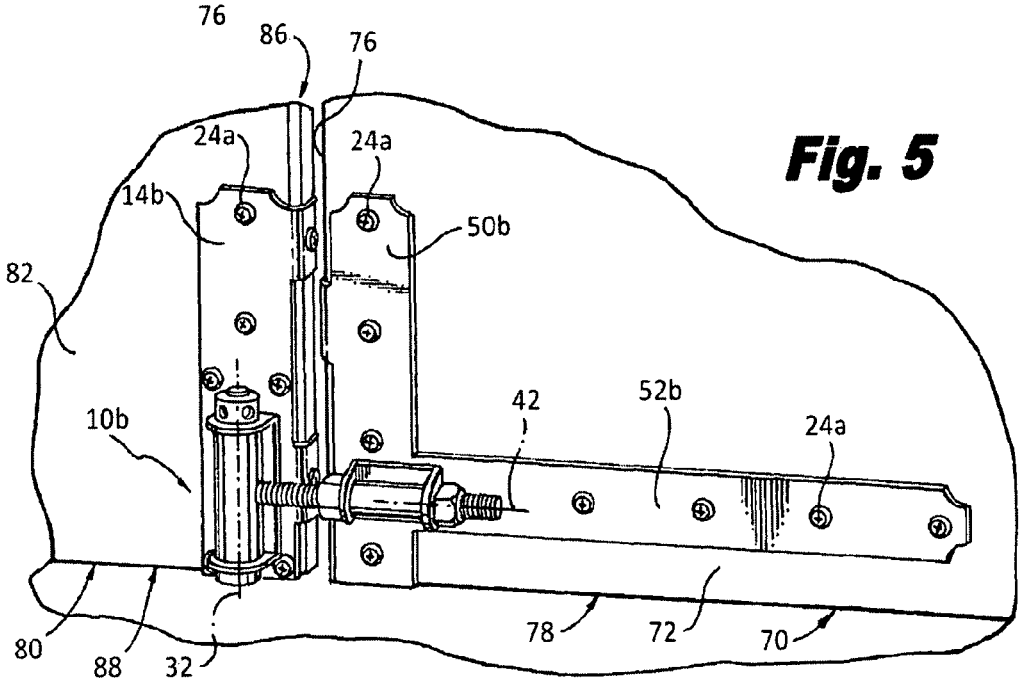
FIG. 5 is a partial perspective view of the lower hinge shown in FIG. 3 attached to the fence gate or swinging door and the wall shown in FIG. 4.

Referring to FIGS. 1-5, wherein like elements have the same reference numerals, a hinge apparatus according to the invention is shown in the illustrative embodiments as upper and lower hinge apparatuses 10*a*, 10*b*. The upper and lower hinge apparatuses 10*a*, 10*b* include top and bottom first support members 14*a*, 14*b*, respectively, for attachment along a first surface 20 of a vertical member embodied as a fence post 18, shown in FIG. 1. Alternatively, top and bottom first support members 14*a*, 14*b* can be attached to a door frame or a first surface 82 of a wall 80, as shown in FIGS. 4 and 5. Both the top and bottom first support members 14*a*, 14*b* include two flanges 16 in spaced relation from each other, as best seen in FIG. 2.

Referring to FIGS. 2 and 3, the flanges 16 extend from the first support members 14*a*, 14*b* and are each bent at a ninety degree (90°) angle defining a first portion 16*a* contiguous with the top and bottom first support members 14*a*, 14*b*, and a second portion 16*b* at about a 90° angle from the top and bottom first support members 14*a*, 14*b*. The first portion 16*a* is arcuate or bent so that the second portion 16*b* extends at about a 90° angle from the top and bottom first support members 14*a*, 14*b*. The second portions 16*b* of the flanges 16 are attached to a second surface 22, of the post 18 adjacent to the first surface 20 of the post 18 using, for example, screws 24*a*, nails or other securing means through a hole 24 in the second portion 16*b* of the flange 16. The second surface 22 is adjacent and generally at about a 90° angle from the first surface 20 of the post 18. The top and bottom first support members 14*a*, 14*b* are also attached to the first surface 20 of the post 18 (FIGS. 1-3), or alternatively the first surface 82 of the wall 80 (FIGS. 4, 5) using screws 24*a* or other means through the holes 24 in the top and bottom first support members 14*a*, 14*b* as shown in FIGS. 1, 4 and 5.

Referring to FIGS. 1-3, a pivot cylinder 30 of the hinge assemblies 10*a*, 10*b* rotates freely within a first frame 33 having ears 34 attached to the first support members 14*a*, 14*b*. The pivot cylinder 30 is positioned towards the top of the top first support member 14*a* to provide an upper hinge assembly 10*a*, and towards the bottom of the bottom first support member 14*b* to provide a lower hinge assembly 10*b*. The pivot cylinder 30 defines an axis of rotation 32 coincident with its longitudinal axis 32.

Second frames 43 having ears 44 are coupled to top and bottom second support members 50*a*, 50*b*. Extended elements 48 have external threads for attachment to the ears 44 using bolts 47 and rotates freely within sleeves 46. The support members 50*a*, 50*b* can rotate about a second axis of rotation 42 coincident with the extended element's 48 longitudinal axis 42. The extended elements 48 couple to the pivot cylinder 30 to attach together the first and second support members 14*a*, 14*b* and 50*a*, 50*b*, respectively. Once coupled together, the upper and lower hinge assemblies 10*a*, 10*b* are adjustable, as, illustratively, the first support member 14*a* can rotate about the axis 32 defined by the rotating/pivoting cylinder 30, and about the axis 42 defined by the sleeve 46 by rotating on the threaded extended element 48, before the first support member is screwed to the fence post 18 and the nuts 47 secured to the ears 44 locking the threaded extended element into position. Further, the second support member 50*a* can rotate about the axis 42 defined by the sleeve 46 before the second support member 50*a* is screwed to the first surface 64 of the fence 60 and the nuts 47 secured to the ears 44 locking the threaded extended element into position. Additionally, the proximity of the first and second support members 14*a*, 14*b* and 50*a*, 50*b*, respectively, can be adjusted by threading the threaded extended element 48 through the ears 44.

The top and bottom second support members 50*a*, 50*b* are connected to horizontal arms 52*a*, 52*b*, respectively forming an L-shape. The horizontal arms 52*a*, 52*b* are attached towards the top of the top second support member 50*a*, and towards the bottom of the bottom second support member 50*b*. The horizontal arms 52*a*, 52*b* are attached to a first surface 64 of the fence gate 60, shown in FIG. 1. Alternatively, the horizontal arms 52*a*, 52*b* are attached to a first surface 72 of a door 70, shown in FIGS. 4 and 5. The horizontal arms 52*a*, 52*b* may be of various lengths differing from the proportions shown in FIGS. 1-5. The horizontal arms 52*a*, 52*b* are advantageous for securing the top and bottom second support members 50*a*, 50*b*, respectively, and thereby the hinge assemblies 10*a*, 10*b*, respectively, to a PVC fence gate by securing the hinge assembly over a greater surface area to reduce the probability of the hinge assembly tearing away from the fence.

The top and bottom second support members 50*a*, 50*b* each include a flange 16 facing the top and bottom first support members 14*a*, 14*b*, respectively. Additionally the top and bottom second support members 50*a*, 50*b*, have a top and bottom flange 16, respectively. The top flange 16 of the top second support member 50*a* mates with a top surface 68 of the fence gate 60, and the bottom flange 16 of the bottom second support member 50*b* mates with a bottom surface 69 of the fence gate 60, as shown in FIG. 1. Alternatively, the top flange of the top second support member 50*a* mates with a top surface 74 of the door 70, and the bottom flange 16 of the bottom second support member 50*b* mates with a bottom surface 78 of the door 70, as shown in FIGS. 4 and 5. The flanges 16 are each bent at ninety degree (90°) angles defining the first portion 16*a* contiguous with the second support members 50*a*, 50*b*, and a second portion 16*b* at about a 90° angle from the second support members 50*a*, 50*b*, as with the flanges 16 on the first support members 14*a*, 14*b*. The second portions 16*b* of the flanges 16 are attached to the top and bottom surfaces 68, 69, respectively, of the fence gate 60, or alternatively the top and bottom surfaces 74, 78, respectively, of the door 70 using, for example, screws 24*a*, nails or other securing means through the holes 24 in the second portions 16*b* of the flanges 16, as shown in FIGS. 1, 4 and 5. Alternatively, the second portions 16*b* of the flanges 16 of the top and bottom second support members 50*a*, 50*b* are similarly attached to the top and bottom surfaces 68, 69, respectively, of the gate 60, and the top and bottom surfaces 74, 78, respectively, of the door 70 using, for example, screws 24*a*, nails, or other securing means through the hole 24 in the second portion 16*b* of the flange 16.

Thus, the hinge assembly may be secured to PVC fencing without tearing the PVC material. As the gate 60 or the door 70 are open and shut, the pivot cylinder 30 allows the swinging motion of the gate 60 or door 70. The vibration associated with the closing or slamming shut of the gate 60 or door 70 does not tear or loosen the hinge assemblies 10*a*, 10*b* from the fence or door because the flanges 16 and first and second top and bottom support members 14*a*, 14*b*, 50*a*, 50*b*, respectively, and arms 52*a*, 52*b* are screwed into the fence post 18 and fence gate 60, or alternatively, the wall 80 and door 70. The thus secured hinge assemblies 10*a*, 10*b* are better able to resist the wear and tear, e.g., vibrational forces, resulting from opening and closing the gate or door, and rotational and shear forces resulting from the weight of the gate, because of the extra support and distribution of forces provided by the flanges 16 and support members 14*a*, 14*b*, 50*a*, 50*b*, and horizontal arms 52*a*, 52*b*.

Further, flanges 16 of the hinge assemblies 10*a*, 10*b* according to the present invention cover any corner welds 19 of the PVC fencing as shown in FIGS. 1 and 4. Thus, the welds 19 are less likely to separate from the forces and vibration of the gate opening and closing because the flanges 16 cover the corner weld 19 area and secure to the adjacent flat surface to strengthen the PVC fencing at the attachment area of the hinge assemblies 10*a*, 10*b*. In the present invention, the use of the flanges occurs on both the post side and the gate side of the fence using surface screws to secure the hinge assemblies 10*a*, 10*b*, which are aesthetically pleasing, faster to implement, and less invasive to the fence than other types of securing means, such as, bolting or screwing a hinge assembly through the fence gate and/or post.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. An apparatus hinging a swinging member to a stationary member, comprising:

a planar first support member for attachment along a first surface of a vertical member, the first support member including at least one flange angularly extending from the first support member and extending from a longitudinal side of the first support member, for attachment along a second surface adjacent to the first surface of the vertical member;

a hinge coupled to a top portion surface of the first support member;

a planar second support member including an extending support arm extending in a plane defined by the second support member and the extended support arm extending angularly from a longitudinal axis defined by the second support member;

an adjustable hinge member adjustably coupled to the hinge and coupled to the second support member such that the adjustable hinge member and the hinge are in adjustable spaced relation to each other, the second support member attached to a first surface of a swinging member opposite the first support member, and the second support member including at least one flange angularly extending from a longitudinal side of the second support member for attachment along a second surface of the swinging member adjacent to the first surface of the swinging member; and another flange of the second support member angularly extending from a longitudinal end of the second support member for attachment to a third surface of the swinging member adjacent to the firs surface of the swinging member.

2. The apparatus assembly of claim 1, wherein the flange is of the first support member extends substantially perpendicularly from the first support member, and the flange is flanges of the second support member extend substantially perpendicularly from the second support member.

3. The apparatus of claim 1, wherein the swinging member is a fence gate and the vertical member is a fence post.

4. The apparatus of claim 1, wherein said at least one flange of said first support member comprises a plurality of flanges, for attachment to the second surface of the vertical member.

5. The apparatus of claim 1, wherein the extended support arm of the second support member is for attachment to the first surface of the swinging member, and he extended support arm extending longitudinally a greater distance than a longitudinal dimension of the second support member.

6. The apparatus of claim 5, wherein the second support member and the extended support arm are substantially perpendicular to each other in an L-shape for mating with the first surface of the swinging member.

7. The apparatus of claim 1, wherein the hinge includes a resilient member coupled support member for rotating the adjustable lunge member about an longitudinal axis of the resilient member and for resiliently returning the swinging member to a beginning position.

8. A hinge system, comprising:

a top planar first support member for attachment to an upper region of a first surface of a vertical member and a bottom planar first support member for attachment to a lower region of the first surface of the vertical member, the top and bottom first support members each including at least on flange angularly extending from the top and bottom first support members and extending from a longitudinal side of each of the top and bottom first support members for attachment along a second surface adjacent to the first surface of the vertical member;

a hinge coupled to a top portion surface of each of the top and bottom support members; and top and bottom second support members for attachment along a first surface of a swinging member, each including extended support arms extending from the top and bottom second support members and extending in planes defined by the top and bottom support members, respectively, and the extended support arms extending angularly from longitudinal axes defined by the top and bottom second support members, respectively;

adjustable hinge members adjustable coupled to respective hinges and coupled to the top and bottom second support members, respectively, such that the adjustable hinge members and the respective hinges are in adjustable spaced relation to each other, the top and bottom second support members each including angularly extending flanges extending from a longitude side of the top and bottom second support members for attachment to a second surface of a swinging member opposite respective top and bottom first support members, and another flange extending from a longitudinal end of the top and bottom second support members for attachment to a third surface of the swinging member adjacent to the first surface of the swinging member.

9. The system of claim 8, wherein the first and second support members are attached to the first surface of the vertical member and the first surface of the swinging member, respectively, using screws, and wherein the screws only penetrate the first surfaces.

10. The system of claim 8, wherein the vertical member is a door frame and the swinging member is a door.

11. The system of claim 8, wherein the vertical member and the swinging member are composed of polyvinyl chloride (PVC).

12. The system of claim 8, wherein the hinge includes a resilient member coupled to the first support member for rotating the adjustable hinge member about an longitudinal axis of the resilient member and for resiliently returning the swinging member to a beginning position, and the second surface of the swinging member is opposite the second surface of the vertical member.

13. A method of hinging a swinging member to a stationary member, comprising:

attaching a first support member along a first surface of a vertical member of the stationary member;

attaching to a second surface of the vertical member adjacent to the first surface of the vertical member with at least one flange angularly extending from the first support member;

coupling a hinge to the first support member;

coupling an adjustable hinge member to a second support member, the second support member including an angularly extending support arm;

attaching the second support member to a first surface of a swinging member opposite the first support member;

attaching another flange angularly extending from the second support member along a second surface of the swinging member adjacent to the first surface of the swinging member; and attaching another flange angularly extending from a longitudinal end of the second support member to a top surface of the swinging member adjacent to the first surface of the swinging member.

14. The method of claim 13, further including:

covering corner welds in the vertical member and the swinging member by attaching the flanges over the corner welds, wherein said vertical member is made of PVC, and said swinging member is a gate made of PVC.

* * * * *